US005289888A

United States Patent [19]

Talley

[11] Patent Number: 5,289,888

[45] Date of Patent: Mar. 1, 1994

[54] WATER WELL COMPLETION METHOD

[75] Inventor: Robert R. Talley, Katy, Tex.

[73] Assignee: RRKT Company, Katy, Tex.

[21] Appl. No.: 888,007

[22] Filed: May 26, 1992

[51] Int. Cl.[5] ..... E21B 7/04

[52] U.S. Cl. ..... 175/61; 175/62; 166/50

[58] Field of Search ..... 175/61, 62, 57; 166/50, 166/51

[56] References Cited

U.S. PATENT DOCUMENTS 4,317,492 3/1982 Summers et al. ..... 175/61 X
4,553,595 11/1985 Huang et al. ..... 166/51 X
4,629,012 12/1986 Schuh ..... 175/61 X
4,832,122 5/1989 Corey et al. ..... 166/52 X
4,878,539 11/1989 Anders ..... 166/52 X
5,040,601 8/1991 Karlsson et al. ..... 166/50 X

*Primary Examiner*—Ramon S. Britts
*Assistant Examiner*—Roger J. Schoeppel
*Attorney, Agent, or Firm*—Bush, Moseley & Riddle

[57] ABSTRACT

In accordance with an illustrative embodiment of the present invention, an irrigation, commercial or municipal utility district high flow capacity water well is completed in a manner such that water is produced from a substantially horizontal lower portion of the well bore that is located in the lower 20% of the water saturated thickness of the aquifer.

6 Claims, 2 Drawing Sheets

WATER WELL COMPLETION METHOD

This application is related to application Ser. No. 07/962,870 filed Oct. 19,1982 and entitled Apparatus and Methods for Horizontal Completion of A water well.

FIELD OF THE INVENTION

This invention relates generally to methods of completing a high productivity water well of the type that is useful for agricultural irrigation or commercial or municipal utility district water production, and particularly to a method of completing a high flow rate water well having a horizontal, or near horizontal, section from which the .water is produced. The completion method of the present invention will, in addition, greatly extend the producing life of a recharge-deficient aquifer.

BACKGROUND OF THE INVENTION

As water is produced from an aquifer such as the Ogallala at a rate that is higher than the aquifer is being recharged by natural processes, the water saturated thickness of the aquifer decreases. Beyond a critical value of saturation thickness, the maximum rate widhdrawn from a well decreases proportionally. This value is directly related withdrawn from a well decreases proportionally. This value is directly related to the rate in gallons per minute of water withdrawal that is required, and inversely related to the permeability of the aquifer. When the pumping rate is increased beyond such critical value, air breaks through the water-air interface at the top of the water saturated zone and curtails water production. When break-through occurs, both air and sand or other sediments can flow to the pump and cause serious damage to it. Thus as the water saturated thickness of an aquifer that is not being naturally recharged in a sufficient manner decreases with time, the well operator is forced to reduce the water production rate, which for crop irrigation reduces the number of acres that can be farmed. When the well is used as a municipal supply, water use must be curtailed by rationing. Eventually, additional water wells will have to be drilled, completed, and put on production to provide the required supply of water. In most cases the drilling and completion costs and the additional power requirements for additional wells make the economics questionable.

It has been recognized, for example in connection with the Ogallala aquifer which accounts for about 30% of the national supply of ground water used for agricultural irrigation, that its water saturated thickness has been declining for many years. See Weeks et al, "Summary Of The High Plains Regional Aquifer-System Analysis In Parts of Colorado, Kansas, Nebraska, New Mexico, Oklahoma, South Dakota, Texas and Wyoming" USGS (1988). From this report it can be recognized that the average water production needed may require a doubling of the number of wells in order to sustain an agricultural area, over the coming 25 year period. The ground water source over a seven county area of Texas was at its critical saturation thickness as far back as 1956. Indeed nearly one-half of the Ogallala aquifer throughout the eight states covered by the Weeks' report had less than 100 feet of saturated thickness left in 1980. Heretofore, the only solution to the problem of reduced water production rates has been to drill, complete and put on production more wells, which will involve very large cost outlays that may not be economically feasible.

A general object of the present invention is to provide a new and improved agricultural, commercial or municipal utility district water well completion method which will extend the producing life of a recharge-deficient aquifer.

Another object of the present invention is to provide a new and improved water well completion method where water entry into the well bore is over a horizontal or near-horizontal section thereof which substantially reduces the possibility of air breakthrough, thereby increasing the maximum flow rate of a single well.

SUMMARY OF THE INVENTION

These and other objects are attained in accordance with the concepts of the present invention through the provision of a water well completion method including the steps of forming the well bore in a manner such that the lower section thereof is horizontal, or near horizontal, and is positioned in the lower 20% of the water saturated thickness of the aquifer. A slotted liner can be used to line the borehole over this section. As water is pumped at high rates from the horizontal section, the possibility of air breakthrough is greatly reduced since the water enters the borehole over an elongated section which is essentially parallel to the air-water interface above it. A much larger volume of the aquifer can be produced by a single well, and the essentially parallel relationship is maintained as the saturated thickness of the aquifer decreases.

BRIEF DESCRIPTION OF THE DRAWINGS

This invention has other objects, features and advantages which will become more clearly apparent in connection with the following detailed description of a preferred embodiment, taken in conjunction with the appended drawings in which.

DETAILED DESCRIPTION OF A PREFERRED EMBODIMENT

Figure 1:
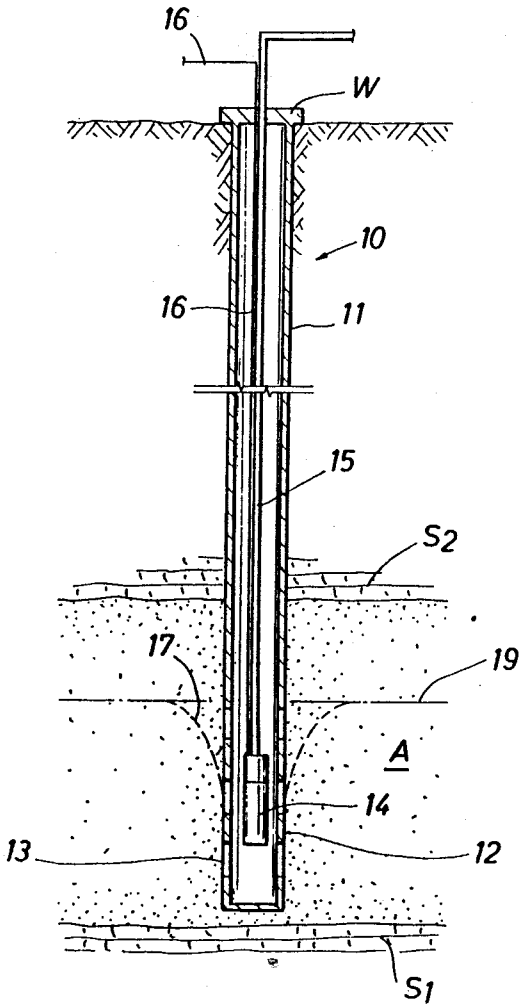
FIG. 1 is a schematic view of a typical vertical well completion.

Referring initially to FIG. 1, a typical water well 10 is drilled vertically and cased at 11 to a total depth that is near the bottom of an aquifer A. In a typical example, the top of the aquifer A typically can be found at about 300 feet below the surface. The aquifer A itself can have an exemplary total thickness of about 150 feet. The dash-dot-dash line 19 indicates the air-water interface which has dropped some due to water production which has not been replaced by natural recharge processes. The bottom of the aquifer A usually is underlain by a shale formation $S_1$, and another layer of shale $S_2$ may overlay it. The sediment of the aquifer itself may be sand, as in the case of the Ogallala formation, or limestone in other water bearing formations.

That portion 12 of the casing 11 that extends below the air-water interface 19 is slotted or perforated to provide ports 13 through which water can enter the well bore. To produce water in such quantities and at such flow rates as are needed in agricultural irrigation or the like, an electric submersible pump 14 can be used. The pump 14 and its electrical motor are suspended in the well 10 on a length of tubing 15 which usually is hung off in a wellhead W in a suitable manner. An electric cable 16 is strapped to the side of the tubing 18 and extends from the motor of the pump 14 up to the surface where it is connected to an electrical power source. Such pumps are capable of pumping water at the high flow rates which are necessary for agricultural irrigation, commercial or municipal water supply purposes. However, at such high flow rates, what can be referred to as "air-coning" indicated at 17 can take place. That is, a conically shaped volume of the formation A having the well bore as its central axis is pumped free of water so that air begins to enter the slotted liner 12 and to curtail water production. The air flow, also entrained sand and other sediments which enter the pump 14 shortly will render it inoperable. As noted above, the only alternative where air-coning and sand production took place was to keep the water production rate down and drill other wells so that the cumulative water production was sufficient for the purposes.

Figure 2:
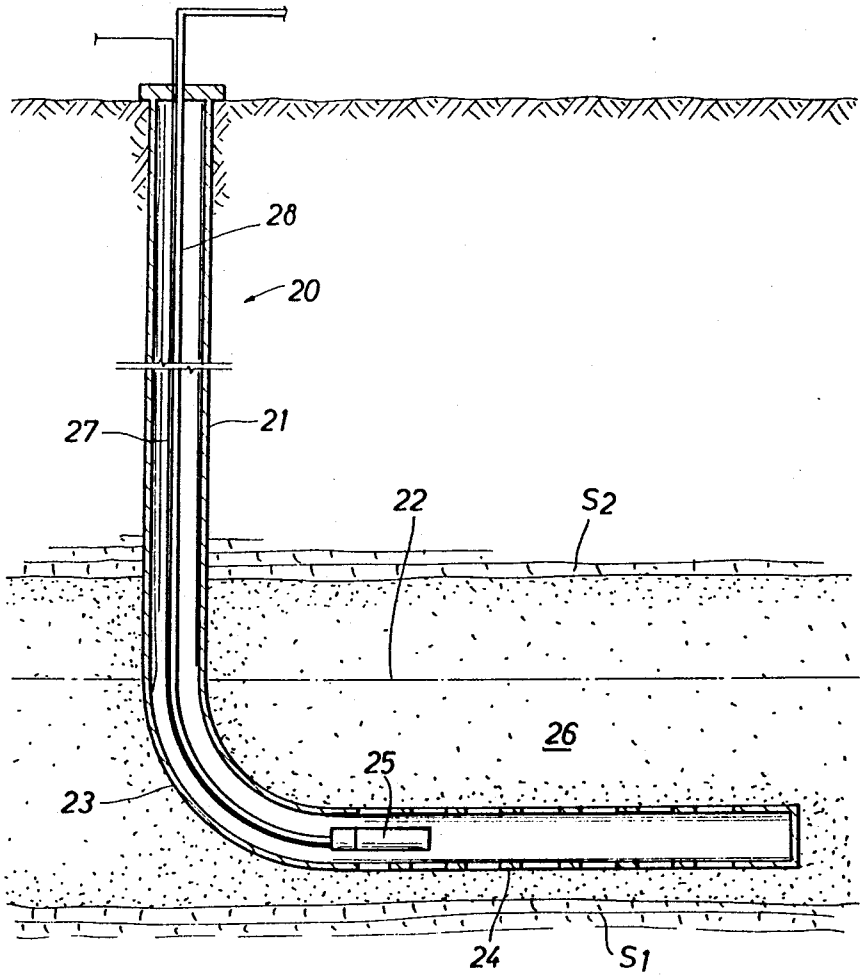
FIG. 2 is a schematic view of a water well completion in accordance with this invention.

A water well completion in accordance with the present invention, and which obviates the foregoing problems, difficulties and limitations, is shown in FIG. 2. Here the well 20 also is lined with casing 21 which extends vertically downward to a depth that is approximately at the level of the air-water interface 22. At this level the well bore is curved throughout a section 23 to an elongated horizontal or near horizontal section 24 in which a slotted liner is used to case the borehole. The electric submersible pump 25 preferably is positioned near the beginning of the horizontal section 24, or near the beginning of the curved section 23, or anywhere in between these two locations. The same type of power line 27 is strapped to the outside of the tubing 28 and leads to the electric motor of the pump 25. The horizontal section 24 of the well bore preferably is located in the bottom 20% of the thickness of the water saturated portion of the aquifer A below the interface line 22. As completed, the water in the aquifer A enters the casing section 24 over a substantial horizontal distance, so that a much greater volume of the water saturated sand is subject to drainage without causing any air-coning or sand entry.

Figure 3:
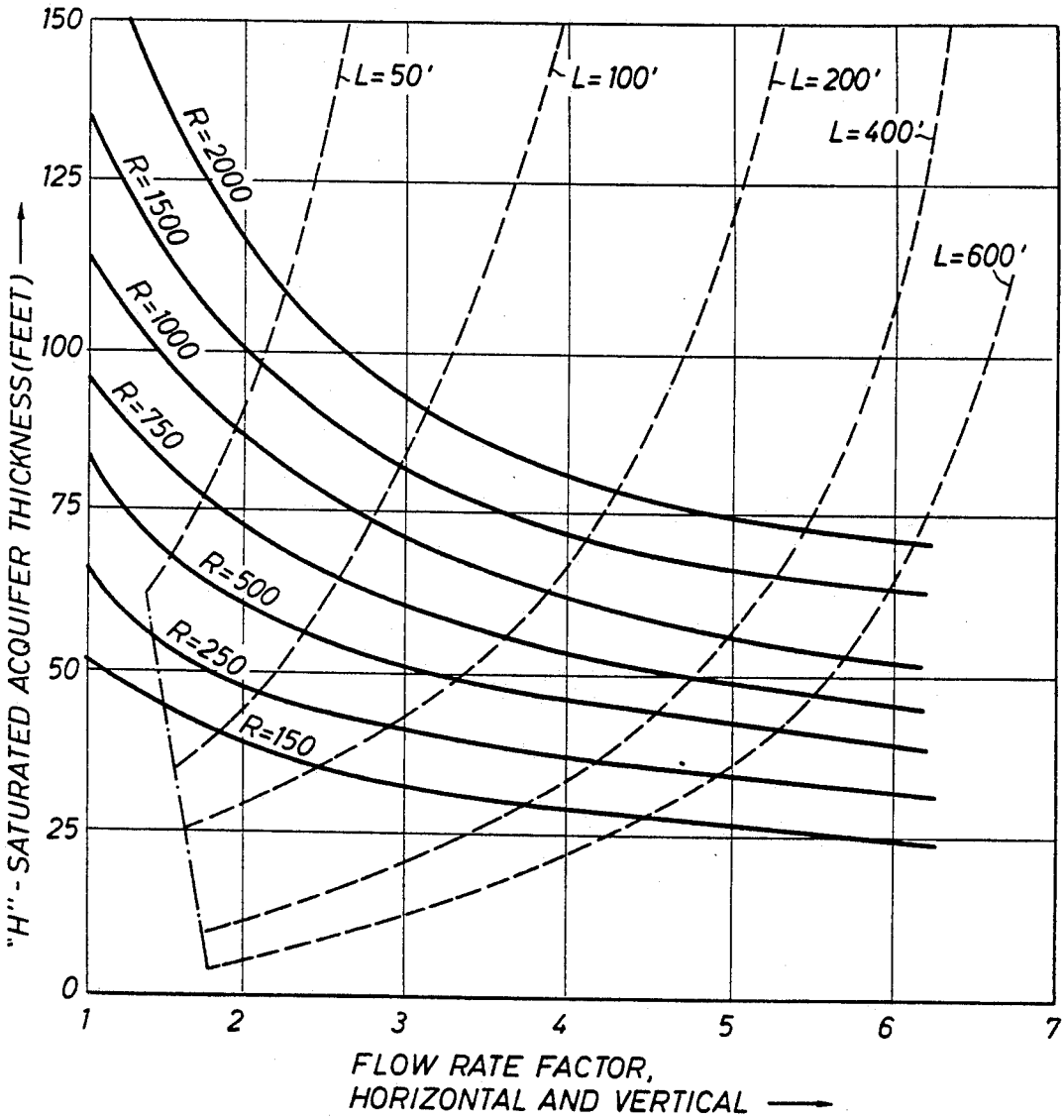
FIG. 3 is a graph showing flow rate factor vs. saturated column thickness for various horizontal lengths of well bores.

A further appreciation of the advantages and features of the present invention may be had with reference to FIG. 3. The horizontal axis of the graph represents a factor which is the ratio of the flow rates that can be achieved from a horizontal completion to those that can be achieved with a vertical completion. Two families of curves are shown. The curves shown in solid lines represent various critical flow rates "R" of water from an aquifer having a permeability of 5,000 m.d., and the curves shown in dash lines represent various horizontal completion lengths "L". From this graph one can determine the length of the horizontal section 24 that is needed to achieve a desired flow rate from an aquifer having a certain thickness of water saturated sediments. For example if the thickness if 100 feet, and the needed flow rate is 1,500 gallons per minute, then a horizontal completion length of about 45 feet will yield satisfactory results. On the other hand where the thickness is 75 feet, and needed flow rate is 1,000 gallons per minute, then a horizontal completion length of about 80 feet is needed. As shown along the ordinate of FIG. 3, the flow rates that can be achieved from a vertical well are about 30 gallons per minute for a 25 foot thickness, 160 gallons per minute for a 50 foot thickness, 400 gallons per minute for a 75 foot thickness, 815 gallons per minute for a 100 foot thickness, and about 1,925 gallons per minute for a 150 foot thickness. Thus it will be apparent from this example that it is possible with a 200 foot long horizontal completion to obtain a flow rate of 1,500 gallons per minute from an aquifer having a water saturated thickness of about 75 feet, whereas with a vertical completion a flow rate of only about 400 gallons per minute can be achieved, which represents approximately a 370% increase in flow rate. The horizontal length in this example would extend across the center of about one surface acre of ground, so that the underground drainage is over a large area. It will be apparent from considering the well and formation geometry contrasted by FIGS. 1 and 2 that a vastly larger formation volume would have to be drained of water before air can possibly enter the horizontal section 24, as compared to the air-cone volume 17 in FIG. 1.

OPERATION

To perform the method of the present invention, the well bore 10 is drilled vertically downward into the aquifer A and to approximately the level of the air-water interface 19. The well bore 10 then is drilled or hydraulically jetted on the curve 23 and then extended horizontally throughout the section 24. The section 24 is drilled in a manner such that it is in the lower 20% of the vertical thickness of the water-saturated region 26 that is between the interface 22 and the top of the shale $S_1$. The well bore 20 then is lined with a casing 21 string that has a slotted liner 24 which extends throughout the length of the section 24. The appropriate length of the horizontal section 24 is determined from the graph shown in FIG. 3 as being an adequate length which will give the necessary flow rate from a vertical thickness of water saturated formation. Then the pump 25 is installed, and the well 20 put on production. The improvement in water production is such that the investment and expense of additional vertical wells is avoided.

It now will be recognized that a new and improved method of completing a high flow rate irrigation, commercial or municipal utility district water well has been disclosed. Since certain changes or modifications may be made in the disclosed embodiment without departing from the inventive concepts involved, it is the aim of the appended claims to cover all such changes and modifications falling within the true spirit and scope of the present invention.

What is claimed is:

1. A method of completing a high flow rate water well for irrigation, commercial or municipal utility district use, comprising the steps of: drilling a vertical portion of the well bore into an aquifer and to approximately the air-water interface level thereon; forming the next portion of the well bore in said aquifer on a curve such that its lower end extends substantially horizontal; extending an outer portion of the well bore substantially horizontally along said aquifer a predetermined distance that is a function of a selected flow rate and the water saturated thickness of the aquifer; casing the well bore in a manner such that said outer portion is provided with water entry ports substantially throughout its length; and installing a pump at a level below said air-water interface by which the water entering said ports can be produced to the surface.

2. The method of claim 1 including the further step of locating said outer portion of said well bore in approximately the lower 20% of the water saturated thickness of said aquifer.

3. The method of claim 1 including the further step of producing said water well at a maximum rate that is dependent upon the length of said outer portion of said well bore.

4. A method of completing a water well that extends into an aquifer having a water saturated thickness below an air-water interface, comprising the steps of: determining the flow rate at which the well will produce a needed amount of water for a selected purpose; from said flow rate and said saturated thickness, determining the length of a substantially horizontal portion of a well bore that will provide said flow rate; drilling and casing a first portion of said well bore that extends from the surface vertically downward to at least the top of said aquifer; hydraulically jetting in and casing a second portion of said well bore that curves through the aquifer from the bottom end of said first portion to substantially the horizontal; and hydraulically jetting in and casing a third section of said well bore which extends substantially horizontally into the aquifer for a distance substantially equal to said determined length, said third section having water entry ports along substantially the entire length thereof.

5. The method of claim 4 including the further step of locating said third section of said well bore in the lower 20% of said saturated thickness.

6. The method of claim 4 including the further steps of positioning a high capacity pump that is suspended on a production tubing at a location in the well bore that is below the upper end of said air-water interface; and driving said pump to produce water through said tubing to the surface.

* * * * *